US012006769B2

(12) United States Patent
Owoeye et al.

(10) Patent No.: US 12,006,769 B2
(45) Date of Patent: Jun. 11, 2024

(54) MODULAR CASING REAMER SHOE SYSTEM WITH JARRING CAPABILITY

(71) Applicant: Saudi Arabian Oil Company, Dhahran (SA)

(72) Inventors: Oladele Owoeye, Dhahran (SA); Peter Egbe, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 146 days.

(21) Appl. No.: 17/451,879

(22) Filed: Oct. 22, 2021

(65) Prior Publication Data

US 2023/0125843 A1 Apr. 27, 2023

(51) Int. Cl.

| | |
|---|---|
| ***E21B 17/14*** | (2006.01) |
| ***E21B 10/32*** | (2006.01) |
| ***E21B 31/107*** | (2006.01) |

(52) U.S. Cl.

CPC ..... *E21B 10/325* (2013.01); *E21B 17/14* (2013.01); *E21B 31/107* (2013.01)

(58) Field of Classification Search

CPC ..... E21B 17/14; E21B 17/07; E21B 17/076; E21B 31/107; E21B 31/113; E21B 31/1135; E21B 10/36; E21B 4/06; E21B 4/12; E21B 4/14; E21B 10/325; E21B 10/32; E21B 10/265; E21B 10/322; E21B 10/327; E21B 10/34; E21B 10/345

See application file for complete search history.

(56) References Cited

U.S. PATENT DOCUMENTS 1,974,664 A * 9/1934 Patten ..... E21B 43/08 175/314

2,249,732 A 7/1941 Green (Continued)

FOREIGN PATENT DOCUMENTS

| | | | |
|---|---|---|---|
| WO | 1994002687 | A1 | 2/1994 |
| WO | 2001042617 | A1 | 6/2001 |
| WO | 2019234519 | A1 | 12/2019 |

OTHER PUBLICATIONS

SLB Energy Glossary entry for "shoe" accessed Jun. 7, 2023 via glossary.slb.com.*

(Continued)

*Primary Examiner* — Blake Michener

(74) *Attorney, Agent, or Firm* — Leason Ellis LLP

(57) ABSTRACT

A modular reamer shoe for connection to an end of a tubular structure, such as a casing or liner, for deployment in a wellbore includes a body configured for connection to the tubular structure (casing or liner). The body includes a first section and an adjacent second section. The first section is connected to the second section such that torque can be transmitted between the first section and the second section. The first section defines a starter reamer defined by a plurality of first cutting elements and second cutting elements spaced from the first cutting elements. The reamer shoe has a plurality of actuatable blades disposed within the second area of the first section. The plurality of blades moves between extended positions and retracted positions. A nose is connected to the first section of the body. The second section is actuatable and can move in an axial direction so as to move the body, including the nose, in forward/rearward directions.

18 Claims, 4 Drawing Sheets

(56) References Cited

U.S. PATENT DOCUMENTS

| | | | | | |
|---|---|---|---|---|---|
| 2,572,308 | A * | 10/1951 | Brown | E21B 17/14 | 137/846 |
| 3,266,577 | A * | 8/1966 | Turner | E21B 17/14 | 166/222 |
| 4,055,226 | A | 10/1977 | Weber | | |
| 6,062,326 | A * | 5/2000 | Strong | E21B 17/1078 | 175/323 |
| 6,401,820 | B1 * | 6/2002 | Kirk | E21B 17/14 | 175/323 |
| 6,443,247 | B1 | 9/2002 | Wardley | | |
| 6,848,517 | B2 | 2/2005 | Wardley | | |
| 6,983,811 | B2 | 1/2006 | Wardley | | |
| 7,216,727 | B2 | 5/2007 | Wardley | | |
| 7,314,099 | B2 | 1/2008 | Dewey | | |
| 7,730,965 | B2 | 6/2010 | Jordan | | |
| 8,006,785 | B2 | 8/2011 | Oldham | | |
| 8,371,387 | B2 | 2/2013 | Blair | | |
| 8,561,729 | B2 | 10/2013 | King | | |
| 10,724,303 | B2 | 7/2020 | Eddison | | |
| 11,459,874 | B1 * | 10/2022 | Stair | E21B 33/12 | |
| 2002/0189863 | A1 * | 12/2002 | Wardley | E21B 10/43 | 175/21 |
| 2003/0164251 | A1 * | 9/2003 | Tulloch | E21B 7/20 | 175/325.1 |
| 2006/0201670 | A1 | 9/2006 | Stewart | | |
| 2007/0199694 | A1 * | 8/2007 | Frazier | E21B 17/14 | 166/242.8 |
| 2007/0289782 | A1 * | 12/2007 | Clark | E21B 17/14 | 175/406 |
| 2010/0252331 | A1 * | 10/2010 | High | E21B 17/042 | 175/320 |
| 2011/0308813 | A1 * | 12/2011 | Barron | E21B 17/14 | 166/376 |
| 2015/0376960 | A1 * | 12/2015 | Rodrigue | E21B 33/14 | 166/241.6 |
| 2023/0069930 | A1 * | 3/2023 | Arsoski | F16K 27/0209 | |

OTHER PUBLICATIONS

Aventus Reamer Shoes; https://aventusoiltools.com/wp-content/uploads/2021/06/REAMER-SHOE-A-ENRFS.pdf; Aug. 10, 2021.

Sledge Hammer; Reamer Shoe Single/Double Valve -SH18-RS; https://www.sledgehammerasia.com/float-equipments/float-collars-pdf/Reamer%20Shoe%20Single-Double%20Valve.pdf; Aug. 10, 2021.

* cited by examiner

MODULAR CASING REAMER SHOE SYSTEM WITH JARRING CAPABILITY

TECHNICAL FIELD

The present disclosure related to a reamer shoe for use in drilled well bore that are typically utilized in oil and gas production and more particularly, relates to a modular casing or liner reamer shoe system with the capability to provide upward and downward jarring forces to a stuck casing or liner.

BACKGROUND

After boring a region of an oil or gas well it is normal to run tubing or lower completions "casing or liner", into the well bore. A typical casing is run into the well bore from the surface and the length of casing is often referred to as a "casing string". The lining of the bore can then be strengthened by introducing cement between the external surface of the casing and the internal surface of the well bore.

As the casing or liner is run through the well bore, it is common for the casing or liner to meet obstructions. The obstructions can take many different forms not limited to hole cleaning challenges with cutting beds in high angle wells, ledges which form in the well bore material during drilling, formation washouts, or debris formed by unstable sections of the well bore wall collapsing. Such obstructions halt the progress of the casing procedure and increase the risk of the casing or liner getting stuck in the wellbore during deployment. To prevent or minimize the effect of these obstructions a reamer shoe is conventionally mounted on the lower end of the casing or liner string. The reamer shoe typically has a plurality of reaming members around the circumference of the shoe body, which remove any irregularities or obstructions from the wall of the bore and thereby facilitate the subsequent passage of the casing string and aid cementing. In conventional reamer shoes, the reaming members extend parallel to the length of the shoe. Whilst this arrangement allows the reaming members to come into contact with the entire circumference of the bore well on rotation of the shoe, complete circumferential coverage of the bore well is not achieved when the shoe is reciprocated.

The shoe is thus designed to ream and clean out the hole as the casing is run and the construction and features of the shoe assist with the hole cleaning.

SUMMARY

A modular reamer shoe configured for connection to an end of a tubular structure, such as a casing or liner, for deployment in a wellbore is disclosed. The reamer shoe includes a body configured for connection to the tubular structure (casing or liner). The body includes a first section and an adjacent second section. The first section is connected to the second section such that torque can be transmitted between the first section and the second section. The first section defines a starter reamer defined by a plurality of first cutting elements located in a first area of the first section. The first section further includes a second area adjacent the first area and a third area adjacent the second area. The third area includes a plurality of second cutting elements. The reamer shoe has a plurality of actuatable blades disposed within the second area of the first section. The plurality of blades moves between extended positions and retracted positions. A nose is connected to the first section of the body. The second section is actuatable and can move in an axial direction so as to move the body, including the nose, in forward/backward directions.

BRIEF DESCRIPTION OF THE DRAWING FIGURES

DETAILED DESCRIPTION OF CERTAIN EMBODIMENTS

Figure 1:
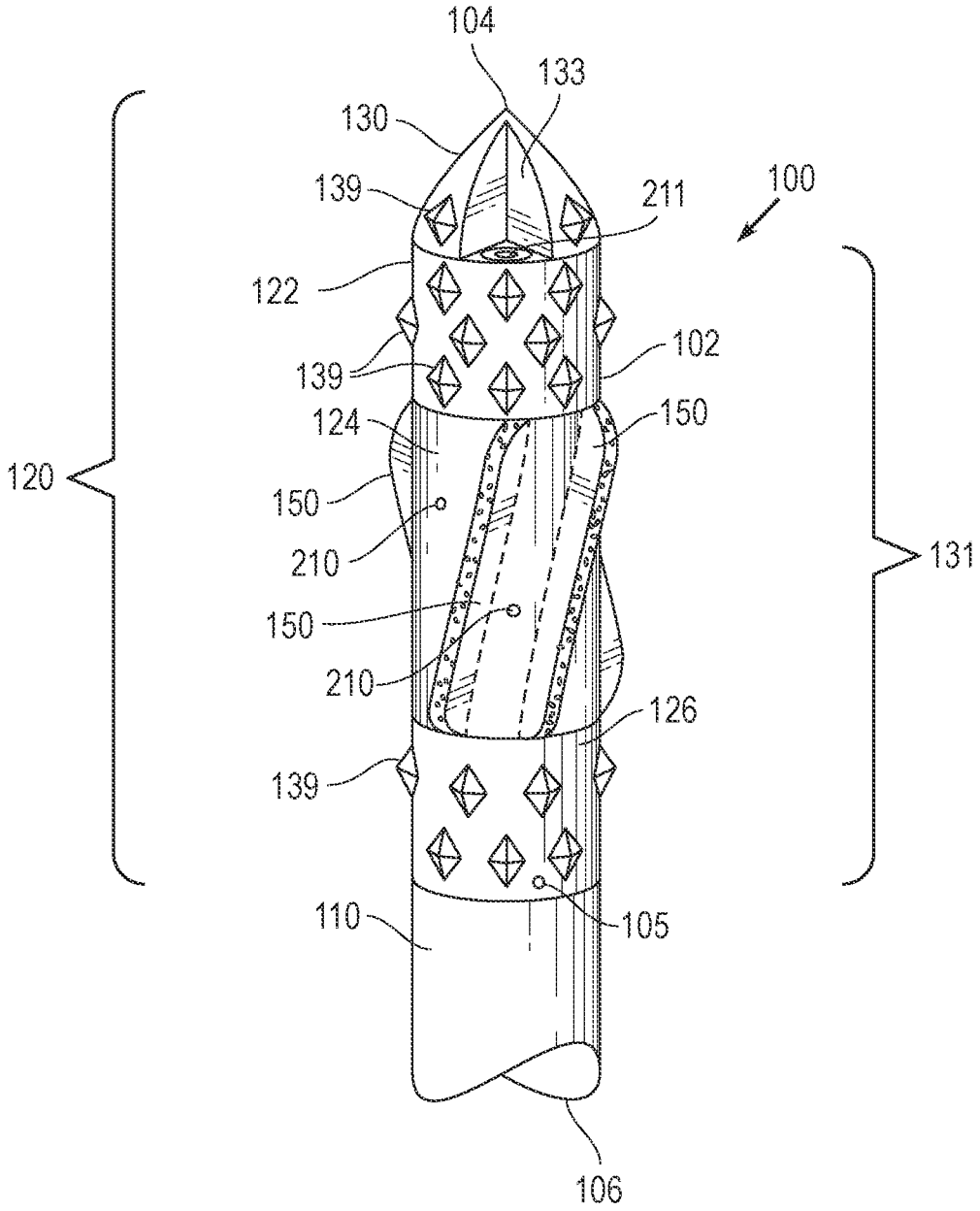
FIG. 1 is a side elevation view of a reamer shoe in accordance with one embodiment with a plurality of blades in fully extended positions.
Figure 2:
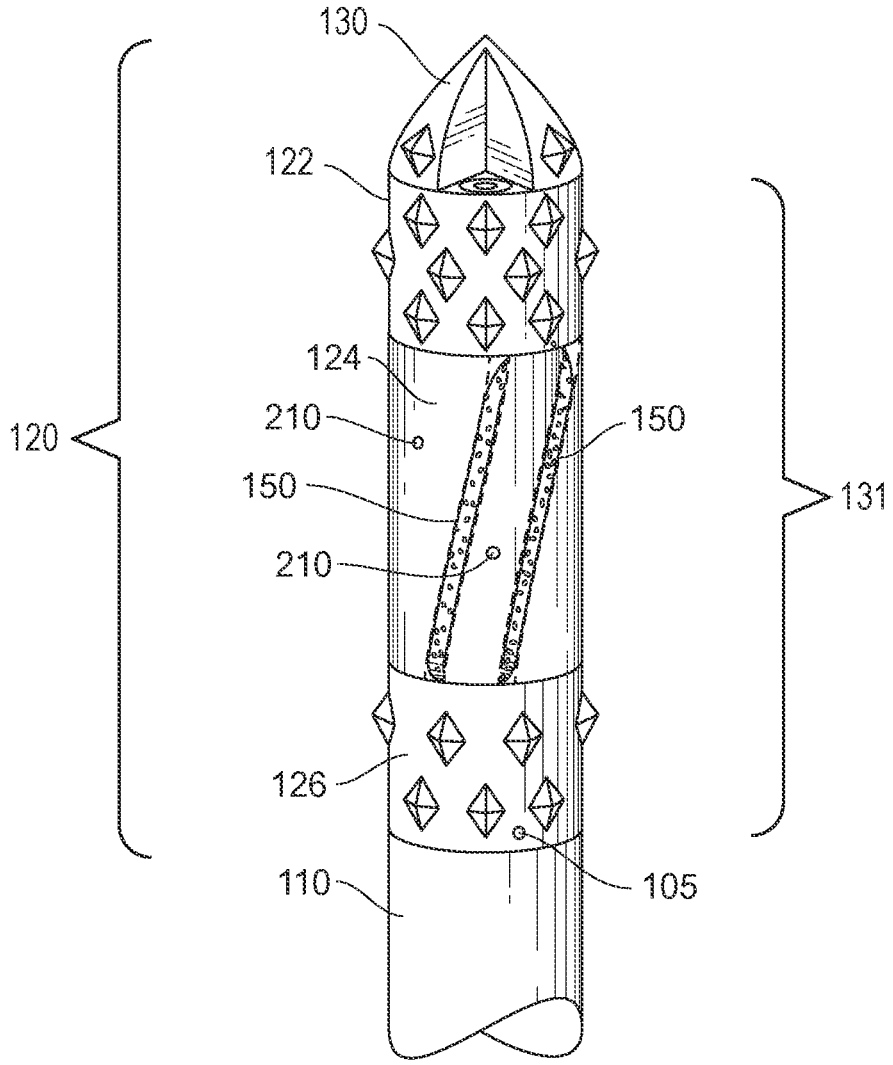
FIG. 2 is a side elevation of the reamer shoe with the plurality of blades in fully retracted positions.

Now turning to FIGS. 1 and 2 in which a modular casing or linear reamer shoe 100 ("reamer shoe 100") is illustrated. The reamer shoe 100 has a generally cylindrical body 102 that has a distal end 104 and an opposing proximal end 106. The cylindrical body 102 can be mounted on the lower end of a casing or liner string (not shown) being deployed in wellbore or used in modules to form part of the casing assembly during casing drilling. The reamer shoe 100 is particularly suited for use in the deployment of casing or liners to bottom. The reamer shoe 100 is effective in long reach applications, horizontal wells, long casing or liner section through hole challenges not limited to the following: tortuous well path, stuck conditions, under gauged hole due to plastic formations, hole cleaning challenges with cutting beds in high angle, horizontal and multilateral wells, ledges and washouts, mobile formations, sloughing and swelling formations, and would provide the casing or liner with complete deployment capabilities to get to bottom. The enhanced casing running capabilities are not limited to washing, rotating, reaming, back reaming, meandering through ledge, jarring to ensure deployment to prognosed depth. Moreover, the reamer shoe 100 also provides a better enabling environment for better cementation and can be used as a well control device during deployment and cementing operation.

Figure 4:
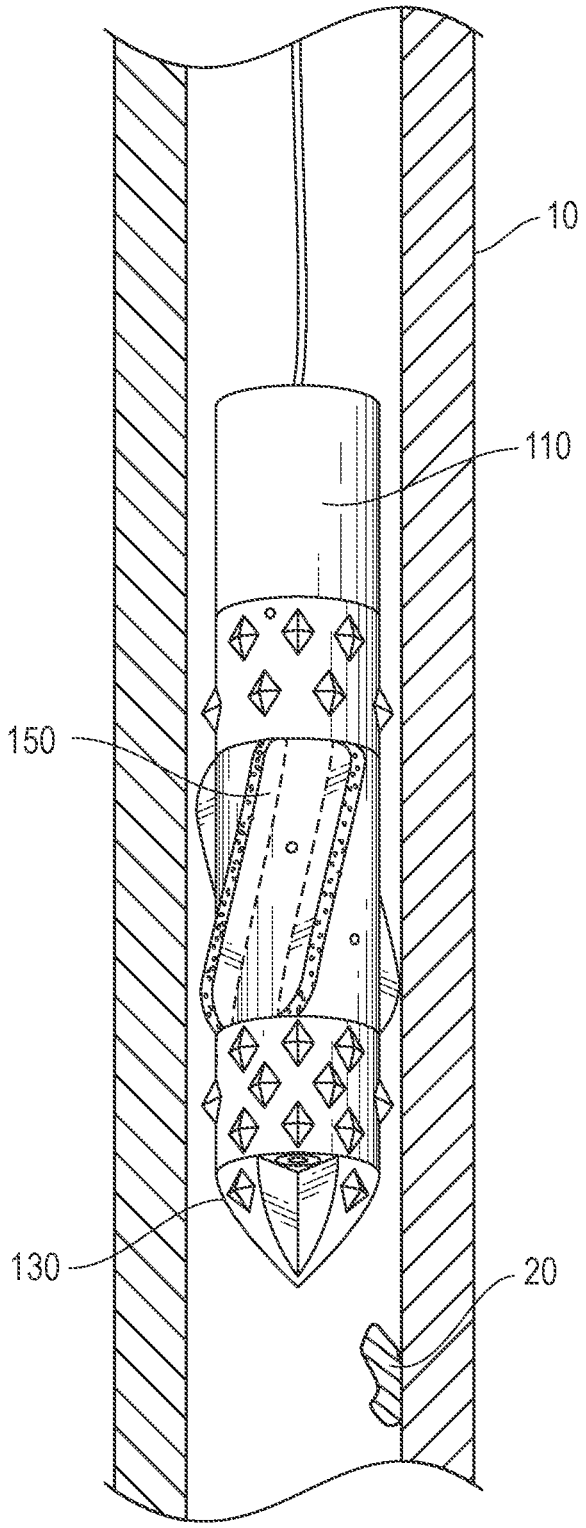
FIG. 4 is a cross-sectional view of a wellbore with an obstruction and the reamer show being advanced therein.

FIG. 4 shows a wellbore 10 with the reamer shoe 100 being advanced therein and an obstruction 20 is shown within the wellbore 10.

As mentioned, the reamer shoe 100 is a modular system and can be thought of as including two sections, namely, an upper (first) section 110 and a lower (second) section 120. For simplicity, the upper section 110 can be considered to be a first section and the lower section 120 can be considered to be a second section. The lower section extends to the distal end 104 and the upper section 110 extends to the proximal end 106. As described herein, the lower section 120 includes a replaceable nose 130. As shown, the replaceable nose 130 defines the distal end 104 and is the distalmost section of the lower section 120.

As described herein, the coupling between the lower section 120 and the upper section 110 is of a type that permits the lower section 120 to rotate relative to the upper section 110.

Lower Section 120

Besides the replaceable nose 130, the lower section 120 can be considered to have other regions or sections that define a main body 131 and in particular, the main body 131 of the lower section 120 includes a first segment or first area 122, an adjacent second segment or second area 124, an adjacent third segment or third area 126, and an adjacent fourth segment or fourth area 128. As shown, the fourth area 128 defines the proximal end of the lower section 120, while the replaceable nose 130 defines the distal end of the lower section 120 (and defines the distal end 104). The above-identified areas are labeled such to assist in describing the different functionality and different physical elements that are present along the length of the lower section 120.

The lower section 120, include the replaceable nose 130, is configured such that it moves as a single structure and more particularly, the lower section 120 can rotate as one unit (a common unit).

Nose 130

The replaceable nose 130 has a curved shape and in particular, can be a dome-shaped or pointed. The replaceable nose 130 can include one or more cut-outs 133 formed circumferentially about the nose 130. The cut-out 133 can extend a substantial length of the nose 130. The presence of one or more cut-outs 133 partitions the nose 130 into distinct nose segments which act as cutting or abrading members which also can be considered to be discrete reaming members typically formed as simple geometrical shapes.

The cutting/reaming members are substantially covered by a relatively hard material, such tungsten carbide or a superhard material such as diamond composite (e.g., polycrystalline diamond compact (PDC)) or cubic boron nitride. The relatively hard material can be applied to the nose 130 and the reaming members, or portions thereof, as a coating that is a layer of film. Alternatively, a non-continuous layer of the material can coat the nose 130 or reaming members. In this instance, the surface of the nose 130 or reaming members comprise areas that are not coated. However, upon rotation of the nose 130, the cumulative effect of the coated areas will be complete circumferential coverage of the inside diameter of the casing.

In one embodiment, as illustrated, preformed elements 139 of the hard or superhard materials are applied to the nose 130 or reaming members in place of a coating or film. It will be understood that the preformed elements 139 comprise the reaming members described above and for ease of discussion, these discrete cutting or reaming members will be described herein as being the preformed elements 139. The preformed elements 139 can be chips, or fragments of the hard material. The cumulative effect of the preformed elements 139 is to cover the surface of the nose 130 or reaming members and so act as a coating thereof. The preformed elements 139 can be directly applied to the nose 130 or reaming members or they can be applied after applying an amenable material either to the nose 130 or reaming members or the preformed elements 139 themselves. One amendable material is nickel substrate.

In the illustrated embodiment, the preformed elements 139 are shown as diamond shaped structure; however, any number of different sizes and shapes can be used, such as chevron, triangular, square shaped, etc. The preformed elements 139 can be formed in a uniform or non-uniform pattern. In addition, the preformed elements 139 can be formed of more than one material and can have more than one shape and/or size.

The replaceable nose 130 can be coupled to the other main body of the lower section 120 using any number of different techniques so long as the coupling results in the replaceable nose 130 and the main body rotating together as the common unit (common structure). For example, the nose 130 can be coupled to the main body of the lower section 120 by a threaded connection.

Main Body 131

The first area 122 of the main body 131 can also include preformed elements 139 which are positioned along the circumference thereof. The preformed elements 139 can have the same attributes as those described above and numbered similarly with respect to the nose 130. The preformed elements 139 in the first area 122 preferably extend about the entire circumference of this area or at least substantially about it. Like in the nose 130, the preformed elements 139 in the first area 122 are formed of hard or superhard materials.

The preformed elements 139 in the first area 122 can formed in a uniform or non-uniform manner. As shown, the preformed elements 139 can be formed along parallel rows that extend circumferentially about the first area 122.

The preformed elements 139 in both the nose 130 and the first area 122 can be thought of as defining and functioning as a starter reamer that begins the reaming operation to overcome wellbore restrictions and to ream out tight spots, which enables the tubular string to reach total depth.

The outer diameter of the nose 130 and the first area 122 can be the same or at least substantially the same.

The second area 124 of the main body 131 comprises a blade section in that a plurality of blades 150 are present in this region. As shown, the plurality of blades 150 are separate from one another and are disposed circumferentially about the second area 124. Each blade 150 can have a spiral shape, as shown; however, other shapes and orientations are equally possible. The blades 150 extend longitudinally within the second area 124 and can be considered to extend from one end of the second area to the other end of the second area 124.

The outer edge of each blade 150 can include a surface features such as cutting surfaces, such as a coating or the preformed elements 139 (hard or superhard cutting elements located along the outer surface(s) of the blade 150).

In another aspect, the plurality of blades 150 are movable and more particularly, the plurality of blades 150 extend between an extend position (FIG. 1) and a retracted position. In the illustrated embodiment, the movement of the plurality of blades 150 is automatic in that the plurality of blades 150 move between the extended positions and the retracted positions and vice versa. In one embodiment, the plurality blades 150 are biased to the extended positions in that the at rest (native) positions of the plurality of blades 150 are the extended positions. For example, the plurality of blades 150 can be spring loaded and the second area 124 can include complementary recesses formed in the body 131 that are configured to fully receive the respective blades 150 in the retracted positions. Thus, when the plurality of blades 150 have spiral shapes, the recesses are likewise spiral in shape. The blades 150 also can be angled relative to the outer surface of the body 131 in that the entire area of each blade 150 can be formed at an angle other than 90 degrees relative to the outer surface of the body 131. In other words, the shoulders of the blades 150 are beveled.

The automatic biasing of the blades 150 is configured such that when forces above a predetermined value (predetermined magnitude) are encountered (e.g., external forces applied to the blades), each blade 150 is able to retract to the retracted position which can be a position in which the outer diameter of the blades 150 is equal to (or at least substantially equal to) the outer diameter of the starter reamer which is defined by the nose 130 and the first area 122, including the preformed elements 139 formed thereon.

The biasing nature of the blades 150 allows them to adjust to well bore diameter as the reamer shoe 100 advances. This automatic adjustment of the blades 150 decreases the risk of erratic torque or damage to the spiral blades 150 and permits adjustment to hole condition.

However, it will be appreciated that the blades 150 can alternatively be of a fixed nature in that the blades 150 can be fixedly attached to the body 131 as per requirements. In either case, the shoulders of the blades 150 are preferably beveled as mentioned above.

The second area 124, which in one embodiment takes the form of a spiral blade section, has a larger effective outer diameter (OD) compared to the starter reamer area (the nose 130 and the first area 122) and the effective OD is preferably greater than the connection OD for a coupled connection but less than the drift of the previous casing string.

As mentioned, the blades 150 can have a hybrid cutter configuration not limited to combination of PDC cutter with tungsten carbide or diamond impregnation along surfaces of the blades 150. In other words, a hybrid cutter is present when there is more than one type of bit cutter structure (e.g., the disclosed tungsten carbide with PDC cutters).

As shown, the exposed outer surface of the blades 150 can include cutting or reaming features (e.g., abrasive surface) as shown by the stippling in the figures.

The size of the second area 124 is typically greater than the first area 122 in that the length of the second area 124 is greater than the first area 122.

The third area 126 is adjacent the second area 124 and defines the proximal most section of the lower section 120.

The third area 126 can include cutting elements, such as preformed elements 139, that are disposed circumferentially about the body 131 within the third area 126. The preformed elements 139 can once again be hard or superhard cutting elements. The first area 122 and the third area 126 can include the same type of cutting elements (e.g., preformed elements 139) or different types of cutting elements can be used. In addition, the arrangement of the cutting elements in the first area 122 can be the same, or similar, or different than that in the third area 126. For example, the cutting elements can be arranged in rows within both the first area 122 and the third area 126; however, as illustrated, the total number of cutting elements can be different in the two different areas 122, 126.

According to one embodiment, the reamer shoe body in the lower section 120 can thus be dressed with two step reamers in both directions (bi-directional) to ensure the main reamer blades 150 receive reduced impact whilst reaming down or back reaming. Thus, depending on the application, the reamer shoe 100 will provide standoff, stabilization, reduced torque and reduced friction when running smart lower completion with large outer diameter accessories. This can replace the need for a dedicated hole enlargement prior to deploying smart lower completions. As will be understood, a two-step reamer is one in which the starter reamer is first to contact and ream the obstruction to size before the main reamer further reduces the obstruction (and thus reduces the load on the main reamer). Bi-directional means that you can ream as you advance forward within the casing and also can ream while the reamer is pulled back in the casing. Both directions provide a two-step reaming system.

The lower section 120 also includes one or more fluid ports as described below.

Upper Section 110

As mentioned, the upper section 110 is coupled to the lower section 120 in a way that permits the lower section 120 to rotate relative to the upper section 110.

The upper section 110 of the modular reamer shoe 100 has the capability to provide an upward and downward jarring force to the casing or liner, should the string be stuck during deployment into the wellbore or whilst tripping out of the wellbore or can be used to provide bump up and down functions during casing or liner deployments if required. In other words, the upper section 110 is configured so that it can move axially under direction from a main controller or the like and this axial movement can be considered to be an up/down or forward/rearward or back/forth movement when the reamer shoe 100 is in the casing or liner.

It will be understood that since the lower section 120 is connected to the upper section 110, the axial movement of the upper section 110 is translated into axial movement of the lower section 120 as well.

The upper section 110 can be telescopic and the axial movement in the upper section 110 of the reamer shoe 100 (upwards and downwards) can be mechanically activated to deliver the corresponding impact force to free the stuck casing or liner string. The axial movement can also act as an enabler for the reamer shoe 100 to be able to deliver constant weight during casing drilling or casing/liner reaming operation. For example, an actuator can be provided to initiate and stop the axial movement and/or control other operating parameters related to the axial movement. Any number of different actuators and mechanics can be used to effectuate the axial movement. For example, a linear actuator can be used to impart linear movement to the upper section 110. The telescoping nature of the upper section 110 allows for axial movement of the upper section 110 since the two or more telescopic parts allow for extension/retraction of the upper section 110.

The activation system to deliver the axial movement in the upper section 110 of the reamer shoe 100 (upwards and downwards) with the corresponding impact force to free the stuck string is thus mechanical and the upper section 110 can be telescopic with stroke length dependent on the specific application and casing size. In other words, the makeup of the telescopic parts and in particular, the number of and lengths of the telescopic parts is selected in view of the particular application (which directly defines the stroke length of the axial movement).

The axial movement of the upper section 110 can also act as an enabler for the reamer shoe 100 to be able to deliver constant weight during casing drilling or casing/liner reaming operation.

The diameter (inner diameter) of the upper section 110 is preferably the same or substantially the same as the diameter of the casing such that there is no loss in casing diameter.

It will thus be appreciated that the rotational movement of the lower section 120 and the axial movement of the upper section 110 (and the connected lower section 120) are two independent motions of the reamer shoe 100 and thus, the operator can instruct rotation and/or axial movement depending upon the encountered circumstances Double Valve Float Now turning to FIGS. 1 and 2, when used purely for casing deployment, the reamer shoe 100 can also include a double valve float mechanism 200 which can act as an extra back pressure valve sealing against pressure from below when floating the casing or liner in long reach well or horizontal wells with long step out. The mechanism 200 will thus close and seal when a predetermined pressure exists and causes movement and closing of the valve. This closing action prevents backflow of gases (pressure surge) and fluids in the liner (e.g., cement, after displacement is complete).

As shown, the double valve float mechanism 200 comprises a pair of float valves 202, 204 located in series within the hollow interior 206 of the tubular shaped lower section 120. The double valve float mechanism 200 also acts to prevent cement back flow during primary cementing operations. The reamer system with the double valve float mechanism 200 can serve as an internal blowout preventer (BOP) with double internal barrier during casing deployment and cementation.

Preferably, the double float valve body of the mechanism 200 can be made of two materials, wherein the surfaces 220 of the valves 202, 204 are made of a first material of relatively thin construction which high resistance to abrasion and erosion and the remainder 222 of the valve body of the valves 202, 204 can be made from another material that is drillable. The surface material used for the double float valve body is not limited to chrome. More suitable alloys can be used depending on their ability to withstand erosion during long circulation and cementing. While the second material of relatively softer metal is not limited to alloys of aluminum.

It will also be appreciated that while, the valve mechanism in the lower section 120 is described as being a double valve float mechanism, other types of valve mechanisms can be used.

Flow Ports

In addition, in order to assist in operation of the reamer shoe 100, the reamer shoe 100 can include one or more flow ports or jet holes that provide for directed flow of fluid from the reamer shoe body (in an outwardly direction).

The body of the reamer shoe 100 and thus can carry a drilling fluid which is pumped from surface through the liner. The various flow ports or jetting ports that are angled relative to the body communicate with the body bore such that, in use, drilling fluid is directed outwardly at a desired angle and at a desired direction, to clear cuttings from between the reaming or cutting elements.

Figure 3:
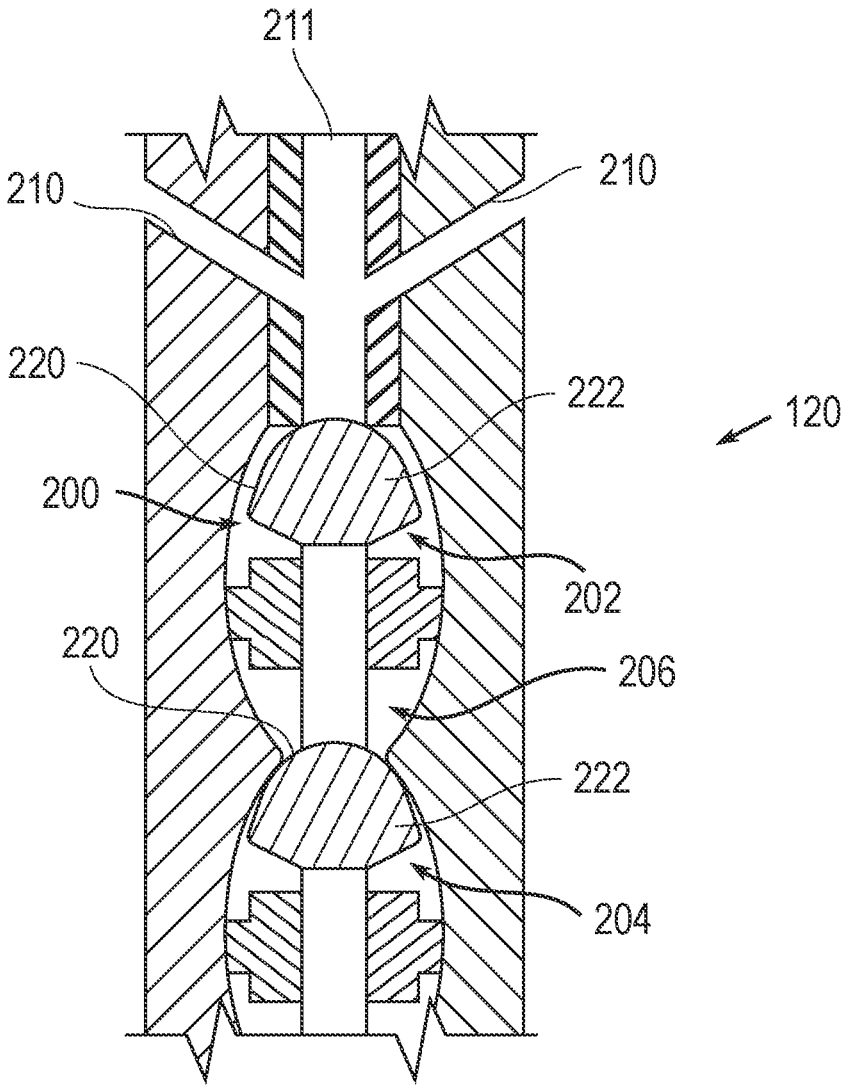
FIG. 3 is a cross-sectional view of a section of the reamer shoe showing a double valve float.

For example, as shown in FIG. 3, the reamer shoe 100 can include flow directed side ports 210 that can be arranged in different patterns around the section of the reamer shoe 100 below the double valve float mechanism 200. In particular, the flow directed side ports 210 are located in the lower section 120. The pattern of the side ports 210 is not limited to spiral configuration. Thus, in addition, the flow directed side ports 210 assist in hole cleaning and to provide a flow part in case of a plugged nose port. As shown in FIG. 3, the flow directed side ports 210 can be formed at angles and open along the exterior of the lower section.

As shown in FIG. 1, one or more of the flow directed side ports 210 can be located within the cut-out 133 formed in the nose 130. When more than one flow directed side ports 210 are used, they can be circumferentially spaced apart along the nose 130. They can be formed in a uniform of non-uniform manner. In addition, the sizes and/or angles of discharge of the flow directed side ports 210 can be the same or can be different.

The configuration of flow directed side ports 210 provides a larger effective flow area for the reamer shoe 100 especially during cementation and in combination with the pattern enhances circumferential coverage of the reamer shoe 100 and helps to prevent channeling, thus ensuring improved zonal isolation. The increased flow area can be used to reduce cementing equivalent circulation density (ECD) and reduce the risk of formation breakdown during cementing where a narrow margin exists thereby reducing the risk of losses during cementing operations.

The modular reamer shoe 100 can include an optional circulating port 105 between the upper section 110 and the lower section 120 of the tool (reamer shoe 100) if required. This can be used for cementing or circulation in case of plugging of the side port(s) 210 and nose port 211 or for pumping lost circulation material (LCM) pills in caser of loss circulation during casing deployment.

The optional circulating port can form part of the lower section 120 further increasing the effective flow area if required. This can be useful when cementing in narrow margins to reduced frictional pressure losses during cementing and keeping cementing pressure below the fracture gradient of the formation.

FIG. 3 shows two flow directed side ports 210. The above-described flow ports offer efficient hole cleaning.

Additional Features

The top and bottom thread connection threads of the full modular reamer shoe 100 can be machined as per API specification with API or proprietary connections as required by the customer and will be compatible with the casing string connection without a requirement for cross-overs. The lower section 120 of the reamer shoe 100 will be pin down such that the nose 130 can be replaced with casing bit if required for casing drilling application for instance.

The improved modular casing or liner reamer shoe 100 can be a hydraulic and mechanical activated, hydraulic or mechanically activated depending on the type of application and whether the full system or module is used.

The casing or liner reamer shoe 100 has the capability to provide an upward and downward jarring force to the casing or liner (due to the axial movement of the upper section 110), should the string be stuck during deployment into the wellbore or whilst tripping out of the wellbore.

Alternatively, the reamer shoe 100 can be used for bump up and down functions not limited to the following: dislodge coupled connections, liner/casing accessories, lower completion accessories not limited to large OD EQ Select & MPAS packer or associated systems that have become stuck or held up during deployment or retrieval from the wellbore. The quick bumping action in either direction can prevent cuttings and/or cavings from settling and wedging the casing or liner string around the large OD casing/liner connection or lower completion accessories.

The modular reamer shoe 100 has the capability to allow similar upward or downward movement of the casing or liner string whether the string is rotating or not, and this capability will always be available to the driller during operations.

The activation system to deliver the axial movement in the upper section 110 of the reamer shoe 100 (upwards and downwards) with the corresponding impact force to free the stuck string is mechanical and the upper section can be telescopic with stroke length dependent on the specific application and casing size. The OD is preferably the same as that of the casing such that there is no loss in casing diameter.

The reamer shoe 100 is preferably made from material that is resistant to impact damage from the jarring process, erosion and abrasion but will not affect the reaming efficiency of the tool.

The reamer shoe 100 described and illustrated herein can be used to maintain a more consistent weight on bit in casing drilling operations below the reamer and will be most effective on floating rigs affected by vessel motion.

When used to maintain weight on bit (WOB) on floating vessel, the magnitude of the free stroke should be greater than the heave of the floating rig. It also potentially results in improved penetration rate and less damage to the bit and reamer cutters.

A similar approach can be utilized to maintain constant weight during casing or liner reaming operation whilst deploying string to bottom. This will minimize wear and damage to the reamer blades and cutters.

The reamer shoe 100 also has the capability to transmit full torque during rotation, reaming or jarring of the casing or liner in case of a stuck event.

The lower section 120 of the reamer shoe 100 with the nose section 130 rotates as one unit and can be hydraulically activated to deliver the required rotation and torque with minimal hack pressure. The rotational tendency can range from low speed high torque system to a high-speed low torque system or even ultra-high speed depending on the specific application The two step reamer shoe 100 with the drillable nose 130 includes, as mentioned above, a starter reamer which can be any configuration not limited to diamond, chevron, triangular, square shape above the nose 130, and on opposite side of a spiral or main blade design. This configuration ensures the main blades 150 receive reduced impact whilst reaming down or back reaming.

The design of the reamer shoe 100 minimizes the impact on the spiral reamer by ensuring that the starter reamer takes the initial impact of wiping the trouble spot followed by the spiral blades 150 whilst reaming down and during back reaming operations (due to controlled axial movement of the upper section 110).

The reamer shoes 100 can be used in situations not limited to reaming trouble spots whilst tripping in or out of the wellbore with casing or liner or casing drilling and is effective wiping out ledges or micro doglegs in the section.

The reamer shoe 100 can improve drilling or completion efficiency as it can potentially eliminate the requirement for a dedicated trip to enlarge the wellbore prior to deploying lower completion especially where large smart completion accessories are used. The latter has been the root cause of many lower completion stuck incidents resulting in high non-productive time, loss of well productivity or extensive fishing and side track operations.

The modular reamer shoe 100 can be anywhere between 10-20 ft long depending on the application and will have same or higher burst and collapse resistance as the casing or liner joints. The internal diameter of the lower section 120 of the reamer shoe 100 is preferably the same as the casing being run and the nose 130 and internal accessories will be drillable with a mill, tri-cone, PDC or hybrid bit.

When used for casing drilling applications, the method of application includes the following: (a) the modular reamer shoe 100 can be utilized in level 2 Casing While Drilling (CwD) with the nose section 130 replaced with a drillable bit. The reamer shoe 100 provides the jarring capability if required during casing drilling together with reaming or back reaming capabilities as required. In addition, the modular reamer shoe 100 can be used as a casing jar and reamer system and can be placed anywhere in the string above the casing steerable motor. When used as in casing drilling, there is no requirement for the two step reamer blade as the bit functions as the starter reamer. Rather the spiral blade(s) 150 has a much larger OD compared to the system used for casing deployment.

The modular reamer shoe 100 can be placed in the casing string in combination with one or more string stabilizers to function as a pendulum system to deliver vertical holes in rotary casing drilling operation.

The reamer shoe 100 is a modular two step reamer shoe 100 that has the capability to ream and enlarge the wellbore if under-gauged or with tight spots or to wipe micro doglegs to reduce drag, increase annular clearance for the large completion accessories in either direction. (i.e., ream down and back ream across troubled spots).

As described herein, the modular casing or liner reamer shoe 100 has the capability to provide upward and downward jarring forces to a stuck casing or liner. The reamer shoe 100 also provides rotational capability and torque to deploy casing and long liners to bottom efficiently through provision of reaming capabilities at constant weight to wipe ledges, tortuous well path, under gauged hole due to plastic formations.

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A modular reamer shoe configured for connection to an end of a tubular structure for deployment in a wellbore, the modular reamer shoe comprising:

a body configured for connection to the tubular structure, the body including a first section and an adjacent second section, the first section being connected to the second section such that torque can be transmitted between the first section and the second section, the second section defining a starter reamer defined by a plurality of first cutting elements located in a first area of the second section, the second section further including a second area adjacent the first area and a third area adjacent the second area, wherein the third area includes a plurality of second cutting elements disposed circumferentially about the entire third area of the body;

a plurality of blades disposed within the second area of the second section; and a nose configured for connection to the second section of the body, wherein the nose includes at least one cut out that extends longitudinally to a distal tip of the nose and partitions the nose into at least two reaming nose segments, the at least one cut out being defined by planar side walls, wherein each reaming nose segment includes a cutting element disposed along an outer surface thereof, wherein each cut out includes a nose port that is located between the planar side walls that define the respective cut out, the nose port axially facing the distal tip of the nose for directing fluid in an axial direction toward the distal tip;

wherein the combination of the body and the nose is dimensioned to fit within the wellbore during deployment of the combination in forward/rearward directions.

2. The modular reamer shoe of claim 1, wherein the nose is connected to the first area of the second section.

3. The modular reamer shoe of claim 1, wherein the first cutting elements comprise preformed elements disposed circumferentially about the body.

4. The modular reamer shoe of claim 3, wherein the preformed elements comprise shaped hardened structures that protrude outwardly from the body.

5. The modular reamer shoe of claim 3, wherein the second cutting elements comprise preformed elements disposed circumferentially about the entire third area of the body, the first and second cutting elements being formed of the same material.

6. The modular reamer shoe of claim 1, wherein the nose defines part of the starter reamer and includes a plurality of third cutting elements.

7. The modular reamer shoe of claim 6, wherein the first and third cutting elements comprise preformed elements disposed circumferentially about the body.

8. The modular reamer shoe of claim 7, wherein the preformed elements comprise shaped hardened structures that protrude outwardly from the body.

9. The modular reamer shoe of claim 1, wherein the second section includes one or more flow directed side ports which open along an exterior of the body and permit fluid to flow from a hollow interior of the body to the exterior of the body.

10. The modular reamer shoe of claim 1, wherein each blade of the plurality of blades has a spiral shape.

11. The modular reamer shoe of claim 10, wherein an outer surface of the blade includes a hardened cutting surface including a plurality of preformed cutting elements.

12. The modular reamer shoe of claim 1, further including a circulating port disposed in the third area of the second section.

13. The modular reamer shoe of claim 1, further including a double valve float disposed within a hollow interior of the body within the second section.

14. The modular reamer shoe of claim 13, wherein the double valve float is formed of two different materials with a valve body of the double valve float being formed of a first material, and a surface of the double valve float being formed of a second material.

15. The modular reamer shoe of claim 1, wherein the outer surface of each reaming nose segment comprises a curved surface that curves inward toward the distal tip.

16. The modular reamer shoe of claim 1, wherein the nose port is formed in a planar surface and intersects the planar side walls that define the cut out.

17. The modular reamer shoe of claim 16, wherein the planar surface is formed perpendicular to the planar side walls.

18. The modular reamer shoe of claim 1, wherein an axis passing through an opening of the nose port is parallel to a longitudinal axis of the body.

* * * * *